US012031394B2

(12) United States Patent
Pucciarello

(10) Patent No.: US 12,031,394 B2
(45) Date of Patent: Jul. 9, 2024

(54) ROD COUPLING REMOVER DEVICE

(71) Applicant: Michael Pucciarello, Saltillo, TX (US)

(72) Inventor: Michael Pucciarello, Saltillo, TX (US)

( * ) Notice: Subject to any disclaimer, the term of this patent is extended or adjusted under 35 U.S.C. 154(b) by 69 days.

(21) Appl. No.: 17/672,509

(22) Filed: Feb. 15, 2022

(65) Prior Publication Data

US 2023/0258045 A1 Aug. 17, 2023

(51) Int. Cl.

| | |
|---|---|
| ***E21B 19/16*** | (2006.01) |
| ***E21B 19/08*** | (2006.01) |
| ***E21B 41/00*** | (2006.01) |

(52) U.S. Cl.

CPC ..... *E21B 19/16* (2013.01); *E21B 19/08* (2013.01); *E21B 41/00* (2013.01)

(58) Field of Classification Search

CPC ..... E21B 19/02; E21B 19/08; E21B 41/00; E21B 19/16

See application file for complete search history.

(56) References Cited

U.S. PATENT DOCUMENTS

| | | | | |
|---|---|---|---|---|
| 2,944,453 | A | 7/1960 | Brewington | |
| 3,708,855 | A | 1/1973 | Whiteside | |
| 4,592,687 | A * | 6/1986 | Piersall | E21D 21/008 411/40 |
| 5,244,314 | A * | 9/1993 | Calandra, Jr. | E21D 21/008 405/259.4 |
| 5,813,104 | A | 9/1998 | Quick | |
| 10,907,422 | B2 | 2/2021 | Gordey | |
| 2002/0025230 | A1 * | 2/2002 | Calandra, Jr. | E21D 21/008 405/259.4 |

FOREIGN PATENT DOCUMENTS

| | | |
|---|---|---|
| GB | 2255382 | 9/1994 |

* cited by examiner

*Primary Examiner* — Robert E Fuller
(74) *Attorney, Agent, or Firm* — Gregson IP Law LLC

(57) ABSTRACT

A rod coupling remover device is a device having a body having a top end, a bottom end, and a shaft opening running from the top end and the bottom end, a bifurcated threaded portion about the bottom end of the body, a retractable wedge, a shaft opening running from a top end to a bottom end of the body, and a threaded shaft member coupled to the retractable wedge at the bottom end of the body. The threaded shaft member passes through the shaft opening of the body in which the retractable wedge is movable into and out of the shaft opening of the body.

10 Claims, 3 Drawing Sheets

ROD COUPLING REMOVER DEVICE

TECHNICAL FIELD

This application relates in general to an article of manufacture for providing an oil extraction device, and more specifically, to an article of manufacture for providing a rod coupling remover device.

BACKGROUND

Oil extraction from wells require a rod string of sucker rods to be coupled together to connect a pumping unit to a pump within the wellhead. In order to maintain the well and ensure its operation, the rod string needs to be maintained with various sucker rods being replaced periodically. A user typically finds the process of removing and attaching each sucker rod from the rod string difficult as the sucker rods are coupled together by a set of rod coupling devices. These rod coupling devices are difficult to restrain while constructing the rod string as the rod coupling devices need to easily move within the wellhead.

Therefore, a need exists for an article of manufacture for providing a rod coupling remover device. The present invention attempts to address the limitations and deficiencies in prior solutions according to the principles and example embodiments disclosed herein.

SUMMARY

In accordance with the present invention, the above and other problems are solved by providing an article of manufacture for a rod coupling remover device according to the principles and example embodiments disclosed herein.

In one embodiment, the present invention is an article of manufacture for providing a rod coupling remover device. The rod coupling remover tool includes a body having a top end, a bottom end, and a shaft opening running from the top end and the bottom end, a bifurcated threaded portion about the bottom end of the body, a retractable wedge, a shaft opening running from a top end to a bottom end of the body, and a threaded shaft member coupled to the retractable wedge at the bottom end of the body. The threaded shaft member passes through the shaft opening of the body in which the retractable wedge is movable into and out of the shaft opening of the body.

In another aspect of the present invention, the remover tool further includes a tightening nut coupled around the threaded shaft member about the top end of the body, the tightening nut rotates about the threaded shaft to prevent movement of the retractable wedge once the retractable wedge is within the shaft opening of the body, and an enlarging slit vertically positioned along the bifurcated threaded portion.

In another aspect of the present invention, the retractable wedge enlarges the bifurcated threaded portion of the body as the retractable wedge enters the shaft opening into the body.

In another aspect of the present invention, the bifurcated threaded portion of the body is configured to engage a rod coupling having a threaded cavity having one or more threaded diameters.

In another aspect of the present invention, the bifurcated threaded portion has a threaded diameter comprising ¾", ⅞", and 1".

The foregoing has outlined rather broadly the features and technical advantages of the present invention in order that the detailed description of the invention that follows may be better understood. Additional features and advantages of the invention will be described hereinafter that form the subject of the claims of the invention.

It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features that are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

Referring now to the drawings in which like reference numbers represent corresponding parts throughout.

DETAILED DESCRIPTION

Figure 1:
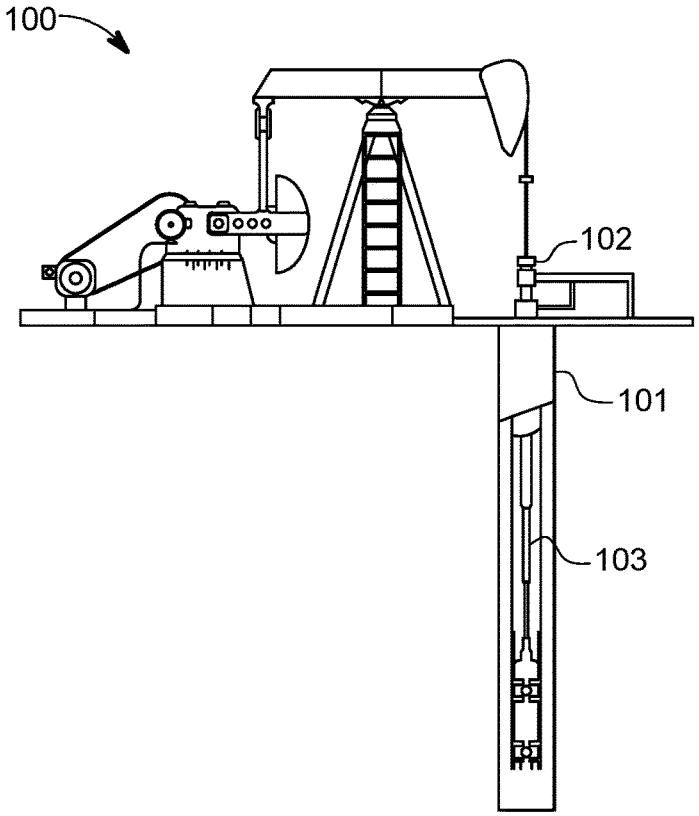
FIG. 1 illustrates example embodiments of an oil well needing an article of manufacture providing a rod coupling remover device according to the present invention.

This application relates in general to an article of manufacture for providing an oil extraction device, and more specifically, to an article of manufacture providing a rod coupling remover device according to the present invention.

Various embodiments of the present invention will be described in detail with reference to the drawings, wherein like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

In describing embodiments of the present invention, the following terminology will be used. The singular forms "a," "an," and "the" include plural referents unless the context clearly dictates otherwise. As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. As used herein, the singular forms "a," "an," and "the" are intended to include the plural forms as well, unless the context clearly indicates otherwise.

It further will be understood that the terms "comprises," "comprising," "includes," and "including" specify the presence of stated features, steps or components, but do not preclude the presence or addition of one or more other features, steps or components. It also should be noted that in some alternative implementations, the functions and acts noted may occur out of the order noted in the figures. For example, two figures shown in succession may in fact be executed substantially concurrently or may sometimes be executed in the reverse order, depending upon the functionality and acts involved.

The terms "individual" and "user" refer to an entity, e.g., a human, using an article of manufacture providing a rod coupling remover device according to the present invention. The term user herein refers to one or more users.

The term "invention" or "present invention" refers to the invention being applied for via the patent application with the title "Rod Coupling Remover Device." Invention may be used interchangeably with remover.

In general, the present disclosure relates to an article of manufacture providing a rod coupling remover device according to the present invention. To better understand the present invention, FIG. 1 illustrates example embodiments of an oil well needing an article of manufacture providing a rod coupling remover device according to the present invention. A typical oil well 100 comprises many components working together to extract the crude oil from the well for capture and use. The crude oil is removed by a pumping unit 102 interacting with a rod string 103 within the wellhead 101. In order for the crude oil to be extracted, a string of sucker rods is combined to create the rod string 103 to connect the pumping unit 102 to the pump 104 within the wellhead 101.

Figure 2:
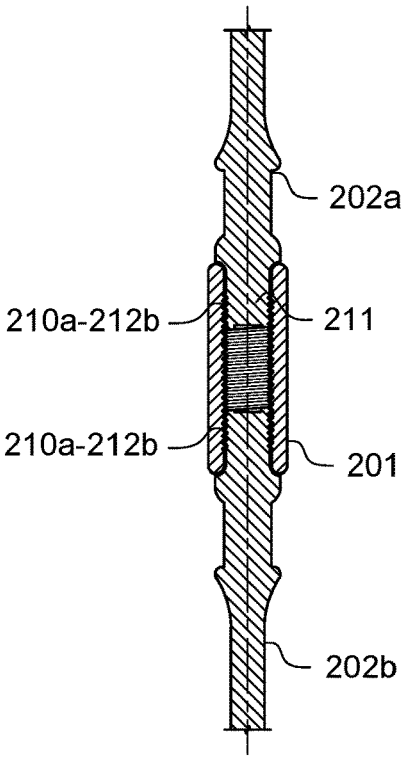
FIG. 2 illustrates a pair of sucker rods connected by a coupling that uses an article of manufacture for a rod coupling remover device according to the present invention.

FIG. 2 illustrates a pair of sucker rods connected by a coupling that uses an article of manufacture providing a rod coupling remover device according to the present invention. In creating the rod string 103, a plurality of sucker rods 202*a-b* is coupled together making a continuous rod string to connect the pumping unit 102 to the pump within the wellhead 101. Each sucker rod 202*a* is connected to a subsequent sucker rod 202*b* within the rod string 103 as shown in FIG. 2. Each end of the sucker rod 202*a* has a threaded end 212*a* that engages a first set of threads 210*a* to a threaded cavity 211 on each end of a rod coupling device 201. The rod coupling device 201 has a second set of threads 210*b* to the threaded cavity 211 for engaging the threaded end 212*b* of the subsequent sucker rod 202*b*.

Figure 3:
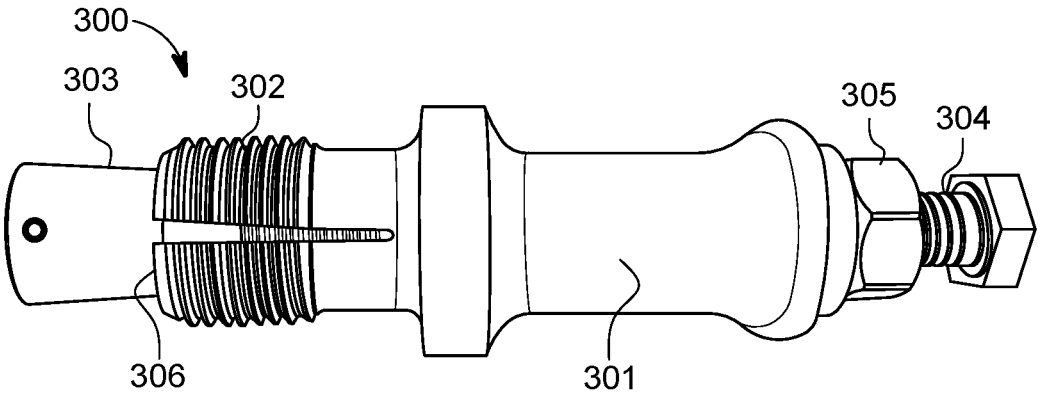
FIG. 3 illustrates an article of manufacture providing a rod coupling remover device according to the present invention

The present invention compromises a tool 300 as shown in FIG. 3, that may have a bifurcated threaded portion for removing couplings used to fasten sucker rods used in oil well production. As such, FIG. 3 illustrates an article of manufacture providing a rod coupling remover device according to the present invention. The rod coupling remover tool 300 comprises a body 301, a bifurcated threaded portion 302, a retractable wedge 303, a threaded shaft member 304 coupled to the retractable wedge 303, and a shaft opening 306 running from a top end to a bottom end of the body. The treaded shaft member 304 passes through a shaft opening 306 within the body 301, and a tightening nut 305.

Figure 4:
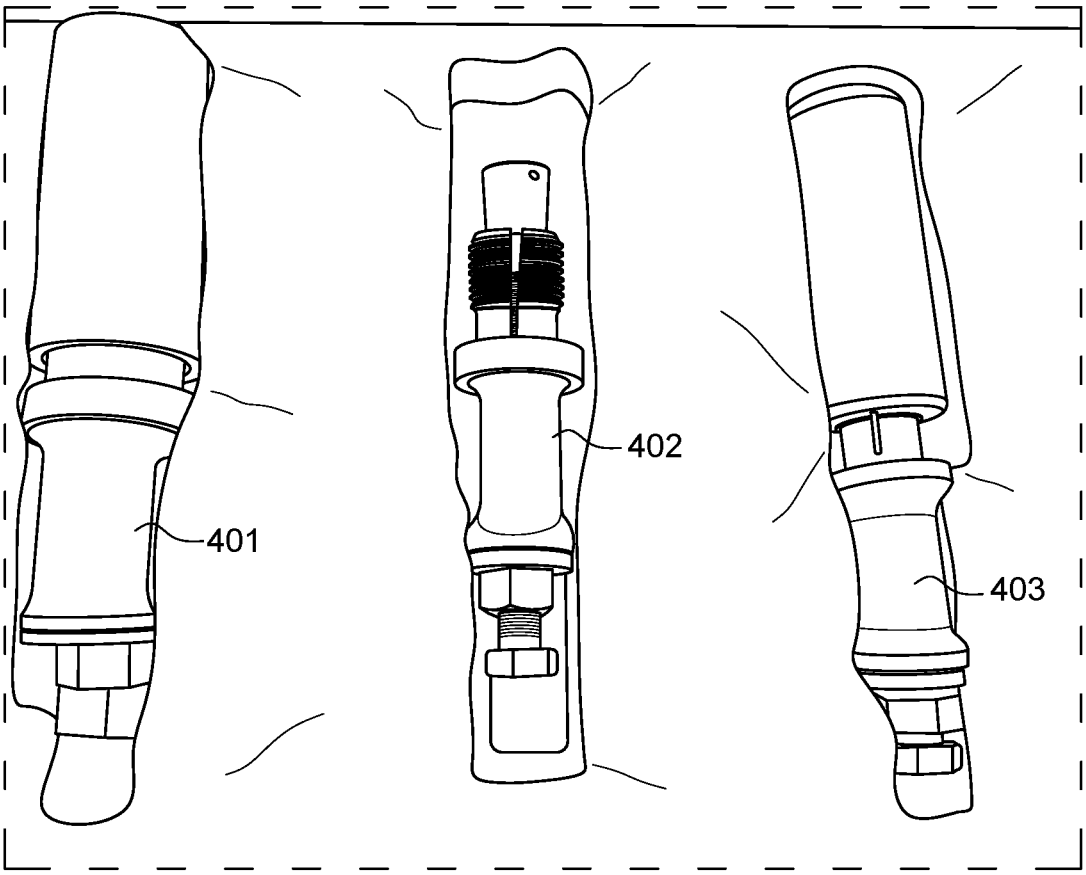
FIG. 4 illustrates different sizes of a first embodiment of an article of manufacture providing a rod coupling remover device according to the present invention.

The bifurcated threaded portion may include the retractable wedge 303 to increase the rod coupling remover tool's 300 ability to remove necessary rod couplings 201 from an existing rod string 103. The rod coupling remover tool 401-403 can be made for all sizes of rod couplings, 1"; ¾"; ⅞" among others as shown in FIG. 4. By increasing the ease of removability of the rod coupling 201, the rod coupling remover tool 300 will decrease down time on producing wells which will increase profit for oil companies worldwide.

To use the rod coupling remover tool 300, the bifurcated threaded portion 302 is coupled to a rod coupling device 201 in the same manner as a sucker rod 202*a-b*. The rod coupling remover tool 300 is easily coupled to a hand-tight configuration by a user.

The retractable wedge 303 may be retracted into the bifurcated threaded portion 302 by pulling the threaded shaft 304 at the opposite end of the body 301. The retractable wedge 303 widens toward its outer end that exerts a force upon the bifurcated threaded portion 302 causing the bifurcated threaded portion 302 to expand via the slot 306 through the bifurcated threaded portion 302. The tightening nut 305 may be rotated to further retract the retractable wedge 303 to tighten the bifurcated threaded portion 302 within the rod coupling device 201. When the tightening nut 305 has been tightened, the rod coupling remover tool 300 is securely coupled within the rod coupling device 201.

The rod coupling remover tool 300 may be secured by securing the body 301 of the rod coupling remover tool 300 to allow a user to untighten and remove a sucker rod 202*b* from the opposite end of the rod coupling device 201. Once the sucker rod 202*b* has been removed from the rod coupling device 201, the rod coupling remover tool 300 also may be removed by untightening the tightening nut 305 and reversing the above steps to disconnect the rod coupling remover tool 300 from the rod coupling device 201.

Figure 5:
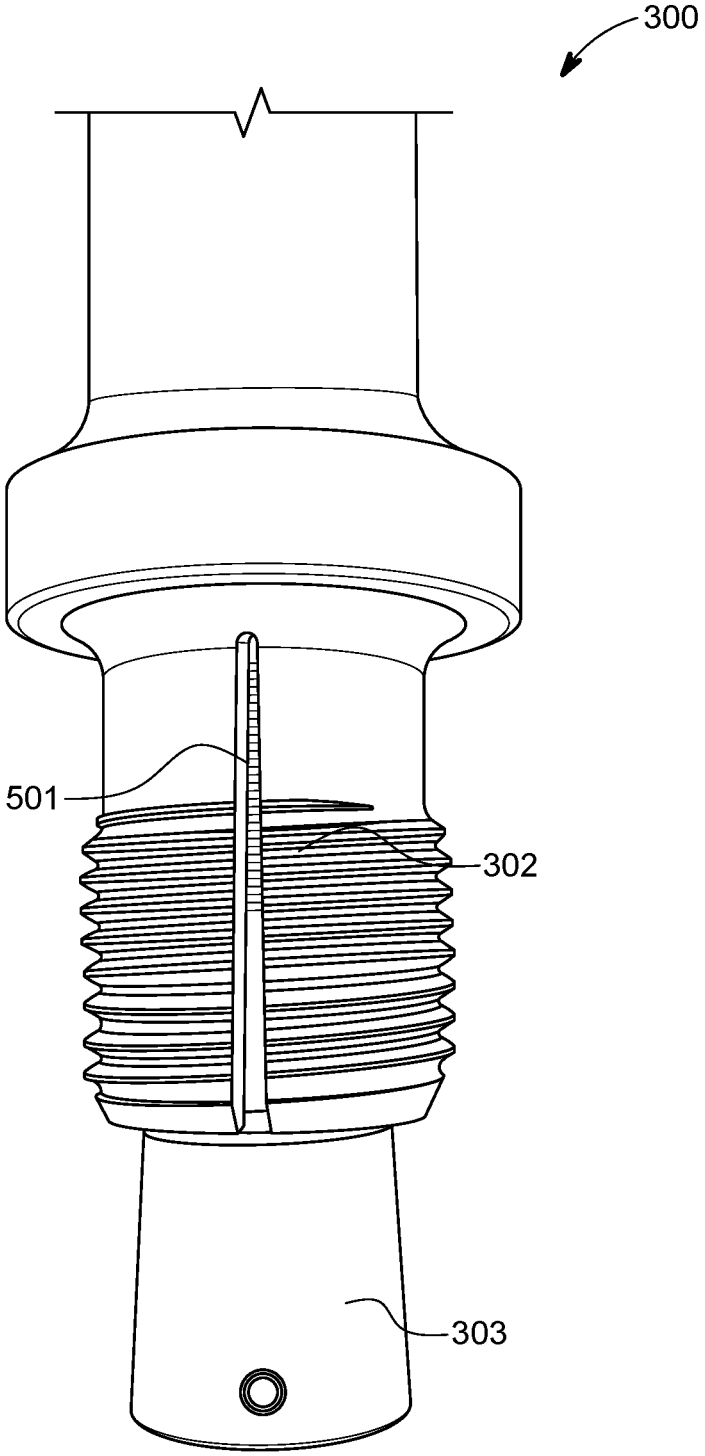
FIG. 5 illustrates a close up view of an article of manufacture providing a rod coupling remover device according to the present invention.

FIG. 5 illustrates a close up view of an article of manufacture providing a rod coupling remover device according to the present invention. In this embodiment, the rod coupling remover tool 300 is shown as the retractable wedge 303 is inserted into the tool. An enlarging slit 501 is located vertically through the bifurcated threaded portion 302 to permit the bifurcated threaded portion 302 to expand outward as the retractable wedge 303 is retracted within the tool 300. When the bifurcated threaded portion 302 has been coupled to the sucker rod 202*a*, the retraction of the retractable wedge 303 increases a retention force between the tool 300 and the coupling 201 to enable the sucker rod 202*a* to be unscrewed from the opposite end of the coupling 201. Once the sucker rod 202*a* has been detached from the coupling 201, the retractable wedge 303 may be extended from within the bifurcated threaded portion 302 of the tool 300 to permit the tool to be detached from the coupling 201.

Even though particular combinations of features are recited in the present application, these combinations are not intended to limit the disclosure of the invention. In fact, many of these features may be combined in ways not specifically recited in this application. In other words, any of the features mentioned in this application may be included in this new invention in any combination or combinations to allow the functionality required for the desired operations.

No element, act, or instruction used in the present application should be construed as critical or essential to the invention unless explicitly described as such. Further, the phrase "based on" is intended to mean "based, at least in part, on" unless explicitly stated otherwise.

What is claimed is:

1. A rod coupling remover device, the rod coupling remover device comprises:

a body having a top end, a bottom end, and a shaft opening running from the top end and the bottom end;

a bifurcated threaded portion about the bottom end of the body;

a retractable wedge;

a shaft opening running from a top end to a bottom end of the body; and a threaded shaft member coupled to the retractable wedge at the bottom end of the body, the threaded shaft member passes through the shaft opening of the body in which the retractable wedge is movable into and out of the shaft opening of the body;

wherein the bifurcated threaded portion at the bottom end of the body is configured to be coupled within a mating set of threads in a rod coupling device having a sucker rod coupled to an opposite end of the rod coupling device;

wherein rotating the threaded shaft member causes the retractable wedge to move into the shaft opening of the body and causes the bifurcated threaded portion to expand corresponding to a width of the retractable wedge within the shaft opening; and the expanding bifurcated threaded portion causes the attached rod coupling device to expand and disengage from the sucker rod.

2. The rod coupling remover device according to claim 1, wherein the remover tool further comprises:

a tightening nut coupled around the threaded shaft member about the top end of the body, the tightening nut rotates about the threaded shaft to prevent movement of the retractable wedge once the retractable wedge is within the shaft opening of the body; and an enlarging slit vertically positioned along the bifurcated threaded portion.

3. The rod coupling remover device tool according to claim 2, wherein the retractable wedge enlarges the bifurcated threaded portion of the body as the retractable wedge enters the shaft opening into the body.

4. The rod coupling remover device tool according to claim 2, wherein the bifurcated threaded portion of the body is configured to engage a rod coupling having a threaded cavity having a threaded diameter.

5. The rod coupling remover device tool according to claim 4, wherein the bifurcated threaded portion has a threaded diameter of ¾", ⅞", or 1".

6. A method of separating a sucker rod from a rod coupling device, comprising:

inserting a rod coupling remover device into a threaded open end of the rod coupling device having the sucker rod coupled to the opposite end, the rod coupling device comprises:

a body having a top end, a bottom end, and a shaft opening running from the top end and the bottom end;

a bifurcated threaded portion about the bottom end of the body;

a retractable wedge;

a shaft opening running from a top end to a bottom end of the body; and a threaded shaft member coupled to the retractable wedge at the bottom end of the body, the threaded shaft member passes through the shaft opening of the body in which the retractable wedge is movable into and out of the shaft opening of the body;

rotating the threaded shaft member causing the retractable wedge to move into the shaft opening of the body and causing the bifurcated threaded portion to expand corresponding to a width of the retractable wedge within the shaft opening; and expanding the bifurcated threaded portion causing the attached rod coupling device to expand; and disengaging the sucker rod from the rod coupling device.

7. The method according to claim 6, wherein the remover tool further comprises:

a tightening nut coupled around the threaded shaft member about the top end of the body, the tightening nut rotates about the threaded shaft to prevent movement of the retractable wedge once the retractable wedge is within the shaft opening of the body; and an enlarging slit vertically positioned along the bifurcated threaded portion.

8. The method according to claim 7, wherein the retractable wedge enlarges the bifurcated threaded portion of the body as the retractable wedge enters the shaft opening into the body.

9. The method according to claim 7, wherein the bifurcated threaded portion of the body is configured to engage a rod coupling having a threaded cavity having a threaded diameter.

10. The method according to claim 9, wherein the bifurcated threaded portion has a threaded diameter of ¾", ⅞", or 1".

* * * * *